US010643417B2

(12) United States Patent
Morinobu et al.

(10) Patent No.: US 10,643,417 B2
(45) Date of Patent: May 5, 2020

(54) MONEY PROCESSING DEVICE

(71) Applicant: FUJI ELECTRIC CO., LTD., Kawasaki-shi, Kanagawa (JP)

(72) Inventors: Shoichi Morinobu, Yokkaichi (JP); Yuta Miyasaka, Ueda (JP); Atsushi Ikemoto, Nagano (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 16/113,394

(22) Filed: Aug. 27, 2018

(65) Prior Publication Data

US 2019/0102964 A1 Apr. 4, 2019

(30) Foreign Application Priority Data

Oct. 3, 2017 (JP) ..... 2017-193388

(51) Int. Cl.

| | |
|---|---|
| ***G07G 1/00*** | (2006.01) |
| ***G07D 1/02*** | (2006.01) |
| ***G07G 1/12*** | (2006.01) |
| ***G07F 19/00*** | (2006.01) |

(52) U.S. Cl.

CPC ..... *G07D 1/02* (2013.01); *G07F 19/202* (2013.01); *G07F 19/209* (2013.01); *G07G 1/12* (2013.01)

(58) Field of Classification Search

CPC ..... G07D 1/02; G07G 1/12
USPC ..... 235/7 A, 379
See application file for complete search history.

(56) References Cited

U.S. PATENT DOCUMENTS 5,121,914 A * 6/1992 Hargreaves ..... B65H 43/00 271/110
2001/0054643 A1* 12/2001 Siemens ..... G07D 11/00 235/379

FOREIGN PATENT DOCUMENTS

JP 2013-246787 A 12/2013

* cited by examiner

*Primary Examiner* — Karl D Frech
(74) *Attorney, Agent, or Firm* — Manabu Kanesaka

(57) ABSTRACT

A money processing device includes a storage unit that stores money, a quantity measurement unit that measures a quantity of the money stored in the storage unit during examination processing, and a control unit that performs control of calculating a remaining time or a degree of progress of the examination processing and notifying the calculated remaining time or degree of progress of the examination processing.

9 Claims, 4 Drawing Sheets

MONEY PROCESSING DEVICE

CROSS-REFERENCE TO RELATED APPLICATION

The priority application number JP2017-193388 filed Oct. 3, 2017, upon which this patent application is based, is hereby incorporated by reference.

BACKGROUND OF THE INVENTION

Field of the Invention

The present invention relates to a money processing device, and more particularly, it relates to a money processing device including a storage unit that stores money.

Description of the Background Art

A money processing device including a storage unit that stores money is known in general, as disclosed in Japanese Patent Laid-Open No. 2013-246787, for example.

Japanese Patent Laid-Open No. 2013-246787 discloses a currency processing device (money processing device) including a storage unit that stores money and examining (confirming) the quantity of money stored in the storage unit. The currency processing device disclosed in Japanese Patent Laid-Open No. 2013-246787 displays a selected examination method on a display unit during examination processing.

However, in the currency processing device (money processing device) disclosed in Japanese Patent Laid-Open No. 2013-246787, the selected examination method is displayed during the examination processing, and thus it can be seen that the examination processing is being performed, but it is difficult to recognize when the examination processing terminates. Therefore, a user cannot disadvantageously leave the currency processing device, and it is difficult for the user to predict the working time. Thus, it is difficult to improve the working efficiency of the user when the examination processing of the currency processing device (money processing device) is conducted.

SUMMARY OF THE INVENTION

The present invention has been proposed in order to solve the aforementioned problem, and an object of the present invention is to provide a money processing device capable of improving the working efficiency of a user when examination processing is conducted.

In order to attain the aforementioned object, a money processing device according to an aspect of the present invention includes a storage unit that stores money, a quantity measurement unit that measures a quantity of the money stored in the storage unit during examination processing of the money, and a control unit that performs control of calculating a remaining time or a degree of progress of the examination processing and notifying the calculated remaining time or degree of progress of the examination processing.

In the aforementioned money processing device according to this aspect, the control unit as described above is provided such that a user can recognize the remaining time or the degree of progress of the examination processing, and thus the user can leave the money processing device or can easily predict the working time. Consequently, it is possible to improve the working efficiency of the user when the examination processing is conducted.

In the aforementioned money processing device according to this aspect, the control unit preferably performs control of notifying the calculated remaining time or degree of progress of the examination processing on a display unit provided in the money processing device or an external device. According to this configuration, the user can easily visually confirm the remaining time or the degree of progress of the examination processing on the display unit of the money processing device or the external device.

In the aforementioned money processing device according to this aspect, the control unit preferably stores the calculated remaining time or degree of progress of the examination processing in a memory storage unit provided in the money processing device or an external device. According to this configuration, the remaining time or the degree of progress of the examination processing can be stored as a log in the memory storage unit, and thus the log is analyzed such that the accuracy of calculating the remaining time or the degree of progress can be improved.

In the aforementioned money processing device according to this aspect, the control unit preferably recalculates the remaining time or the degree of progress of the examination processing when additional examination processing occurs. According to this configuration, even when the additional examination processing occurs and the examination processing does not proceed based on the time calculated at the start of the examination, it is possible to recalculate and notify the remaining time or the degree of progress of the examination processing, and thus the user can recognize the accurate remaining time or degree of progress even when the additional examination processing occurs.

In this case, the control unit preferably performs control of notifying the recalculated remaining time or degree of progress of the examination processing when the remaining time or the degree of progress of the examination processing is recalculated. According to this configuration, even when the additional examination processing occurs and the examination processing does not proceed based on the time calculated at the start of the examination, it is possible to recalculate and notify the remaining time or the degree of progress of the examination processing, and thus the user can correct the schedule. Accordingly, even when the time of the examination processing is extended, it is possible to significantly reduce or prevent a decrease in the working efficiency of the user.

In the aforementioned money processing device according to this aspect, the control unit preferably calculates the remaining time of the examination processing based on a time required to withdraw, from the storage unit, the money stored in the storage unit, a time required to store, in the storage unit, the money withdrawn from the storage unit, an empty determination time required to determine that the storage unit is empty, and a predicted quantity of the money that seems to be in the storage unit. According to this configuration, the remaining time of the examination processing can be easily calculated according to the predicted quantity of the money.

In this case, the control unit preferably calculates the remaining time of the examination processing based on a time required to withdraw, from the storage unit at a first speed, the money stored in the storage unit, a predicted quantity of the money, which seems to be in the storage unit, to be withdrawn at the first speed, a time required to withdraw, from the storage unit at a second speed lower than the first speed, the money stored in the storage unit, a predicted quantity of the money, which seems to be in the storage unit, to be withdrawn at the second speed, the time required to store, in the storage unit, the money withdrawn from the storage unit, and the empty determination time.

According to this configuration, the time can be calculated by distinguishing the case where the money is withdrawn from the storage unit at the high speed from the case where the money is withdrawn from the storage unit at the low speed, and thus the remaining time of the examination processing can be calculated more accurately.

In the aforementioned money processing device according to this aspect, the control unit preferably calculates the degree of progress of the examination processing based on the remaining time of the examination processing calculated at a start of the examination processing and an elapsed time. According to this configuration, the degree of progress of the examination processing can be calculated on the basis of time, and thus the user who has confirmed the degree of progress of the examination processing can easily recognize the progress of the examination processing.

In the aforementioned money processing device according to this aspect, the control unit preferably notifies the degree of progress smaller than the calculated degree of progress of the examination processing in consideration of occurrence of additional examination processing, notifies the calculated degree of progress of the examination processing when it is determined that the additional examination processing does not occur, and notifies the degree of progress more progressed than the notified degree of progress as a continuation of the notified degree of progress when the additional examination processing occurs. According to this configuration, even when the additional examination processing occurs, the degree of progress more progressed than the originally notified degree of progress is notified, and the notified degree of progress is not reduced, and thus it is possible to significantly reduce or prevent occurrence of an excessive waiting time for the user who expects the examination processing to terminate.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is hereinafter described with reference to the drawings.

(Configuration of Money Processing Device)

The configuration of a money processing device (change machine) 100 according to the embodiment of the present invention is now described with reference to FIGS. 1 and 2.

Figure 1:
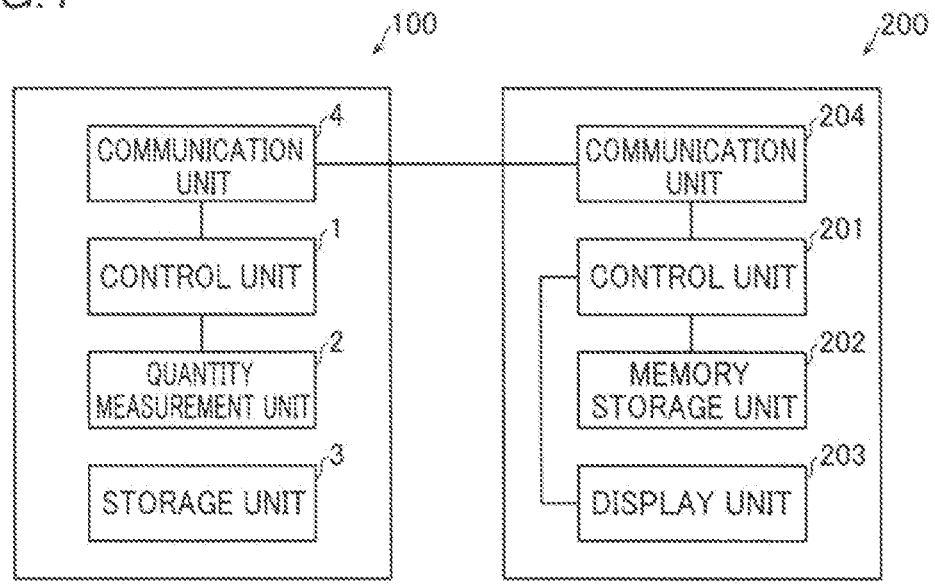
FIG. 1 is a block diagram showing the control configuration of a money processing device according to an embodiment of the present invention.

A money processing device 100 according to the embodiment of the present invention shown in FIG. 1 is connected to an external device 200. The device 200 is a POS (point of sales) register, a computer, or the like, for example. The money processing device 100 can store money (coins). Furthermore, the money processing device 100 outputs money (coins) as change. Another money processing device capable of storing money (banknotes) is connected to the device 200. The money processing device 100 is a device installed in a store such as a supermarket and that constitutes a portion of a POS system. The money processing device 100 is used in a state where a seller (user) performs accounting, for example.

As shown in FIG. 1, the money processing device 100 includes a control unit 1, a quantity measurement unit 2, a storage unit 3, and a communication unit 4. The external device 200 includes a control unit 201, a memory storage unit 202, a display unit 203, and a communication unit 204. The money processing device 100 and the external device 200 are communicably connected via the communication units 4 and 204.

Figure 2:
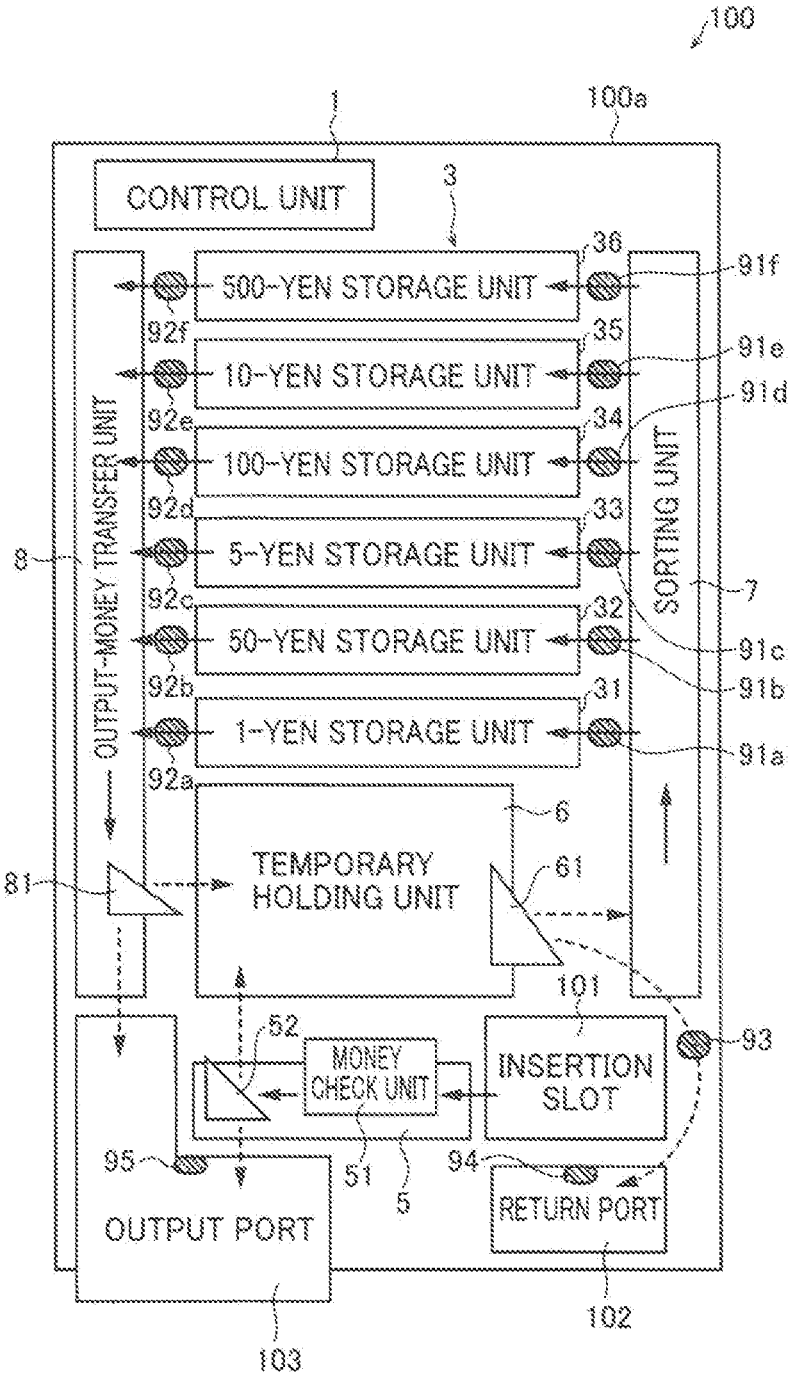
FIG. 2 is a plan view illustrating the configuration of the money processing device according to the embodiment of the present invention.

As shown in FIG. 2, the money processing device 100 includes a box-shaped housing 100*a*. The housing 100*a* includes an insertion slot 101, a return port 102, and an output port 103. Furthermore, the money processing device 100 includes an input-money transfer unit 5, a temporary holding unit 6, a sorting unit 7, and an output-money transfer unit 8. In addition, the storage unit 3 includes a 1-yen storage unit 31 that stores 1 yen, a 50-yen storage unit 32 that stores 50 yen, a 5-yen storage unit 33 that stores 5 yen, a 100-yen storage unit 34 that stores 100 yen, a 10-yen storage unit 35 that stores 10 yen, and a 500-yen storage unit 36 that stores 500 yen. The input-money transfer unit 5 includes a money check unit 51 and an input-money switching gate 52. The temporary holding unit 6 includes a storage switching gate 61. The output-money transfer unit 8 includes an output-money switching gate 81.

The money processing device 100 includes a plurality of sensors. Specifically, the money processing device 100 includes six sort counting sensors 91*a*, 91*b*, 91*c*, 91*d*, 91*e*, and 91*f*, six withdrawal counting sensors 92*a*, 92*b*, 92*c*, 92*d*, 92*e*, and 92*f*, a discharge counting sensor 93, and residual detection sensors 94 and 95.

The control unit 1 includes a CPU and a memory, and controls each unit of the money processing device 100.

The control unit 1 performs control of managing the quantity of stored money in the storage unit 3. Specifically, the control unit 1 distinguishes and manages the quantity of money stored in each of the 1-yen storage unit 31, the 50-yen storage unit 32, the 5-yen storage unit 33, the 100-yen storage unit 34, the 10-yen storage unit 35, and the 500-yen storage unit 36. The control unit 1 manages the quantity of money stored in the storage unit 3 based on information about the quantity stored in the storage unit 3, information about the sorted quantity counted by the sort counting sensors 91*a* to 91*f*, and information about the withdrawn quantity counted by the withdrawal sensors 92*a* to 92*f*. In other words, the control unit 1 updates and manages the quantity of money as the newly stored quantity=the previously stored quantity+the sorted quantity−the withdrawn quantity.

The control unit 1 performs control of checking the money inserted through the insertion slot 101 and transferring the money to the temporary holding unit 6. Specifically, the control unit 1 controls the input-money transfer unit 5 to transfer the money inserted through the insertion slot 101 and controls the money check unit 51 to check the money during the transfer. When the checked money is genuine, the money is transferred to the temporary holding unit 6. On the other hand, when the checked medium is not genuine money, the medium is discharged to the output port 103. In other words, the control unit 1 performs control of delivering the medium to the temporary holding unit 6 or the output port 103 by switching a transfer destination route of the input-money switching gate 52.

The control unit 1 performs control of storing the money held in the temporary holding unit 6 in the storage unit 3. Specifically, the control unit 1 performs control of delivering the money held in the temporary holding unit 6 to the sorting unit 7 via the storage switching gate 61. Then, the control unit 1 performs control of delivering the money to the storage unit 3 while sorting the money into each denomination by the sorting unit 7. Furthermore, the control unit 1 controls the sort counting sensors 91*a*, 91*b*, 91*c*, 91*d*, 91*e*, and 91*f* to count the money stored in the storage unit 3 for each denomination, and records the quantity of money stored in the storage unit 3.

The control unit 1 performs control of delivering the money from the storage unit 3 to the output-money transfer unit 8. For example, the control unit 1 delivers the money from the storage unit 3 to the output-money transfer unit 8 when outputting the money as change or when conducting examination processing to examine the quantity of money. Furthermore, in this case, the control unit 1 controls the withdrawal counting sensors 92*a*, 92*b*, 92*c*, 92*d*, 92*e*, and 92*f* to count the money delivered from the storage unit 3 for each denomination, and records the quantity of money delivered from the storage unit 3.

The control unit 1 performs control of withdrawing the money for change from the storage unit 3 and discharging the money to the output port 103. Specifically, the control unit 1 controls the output-money switching gate 81 to switch a transfer destination route for the money to be withdrawn from the storage unit 3 to the output port 103, and performs control of withdrawing the money for change from the storage unit 3.

The control unit 1 performs control of delivering the return money from the temporary holding unit 6 and discharging the money to the return port 102. Specifically, the control unit 1 controls the storage switching gate 61 to switch a transfer destination route for the money delivered from the temporary holding unit 6 to the return port 102 and perform control of delivering the return money from the temporary holding unit 6.

When determining in the money check unit 51 that the medium input from the insertion slot 101 is not genuine money, the control unit 1 performs control of discharging the medium determined to be not genuine money to the output port 103. Specifically, the control unit 1 controls the input-money switching gate 52 to switch a transfer destination route for the medium inserted from the insertion slot 101 to the output port 103, and controls the input-money transfer unit 5 to transfer the medium determined to be not genuine money and directly discharge the money to the output port 103.

The control unit 1 performs the examination processing to examine the quantity of money stored in the storage unit 3. The examination processing is processing of recounting the quantity of money stored in the storage unit 3. Specifically, the money is delivered from the storage unit 3 to the temporary holding unit 6 via the output-money transfer unit 8. Then, the money is returned from the temporary holding unit 6 to the storage unit 3 via the sorting unit 7. At this time, the quantity measurement unit 2 measures the quantity of money to be delivered. That is, the examination processing is performed by circulating the money of the storage unit 3 inside the housing 100*a* without ejecting the money of the storage unit 3 from the output port 103 and the return port 102. The examination processing is started based on user's operation.

The quantity measurement unit 2 measures the quantity of money stored in the storage unit 3 during the examination processing. Specifically, the quantity measurement unit 2 includes the sort counting sensors 91*a*, 91*b*, 91*c*, 91*d*, 91*e*, and 91*f* and the withdrawal counting sensors 92*a*, 92*b*, 92*c*, 92*d*, 92*e*, and 92*f*. The quantity measurement unit 2 measures the quantity of money delivered from the storage unit 3 to the output-money transfer unit 8 for each denomination by the withdrawal counting sensors 92*a*, 92*b*, 92*c*, 92*d*, 92*e*, and 92*f* during the examination processing. Furthermore, the quantity measurement unit 2 measures the quantity of money sorted and delivered from the sorting unit 7 into the storage unit 3 for each denomination by the sort counting sensors 91*a*, 91*b*, 91*c*, 91*d*, 91*e*, and 91*f* during the examination processing.

When the examination processing is conducted, the withdrawal counting sensors 92*a* to 92*f* measure the quantity of money withdrawn from the storage unit 3, and the sort counting sensors 91*a* to 91*f* measure the quantity of money stored again in the storage unit 3.

The storage unit 3 stores money. Specifically, the storage unit 3 stores money for each denomination. That is, 1-yen coins are stored in the 1-yen storage unit 31 of the storage unit 3. 50-yen coins are stored in the 50-yen storage unit 32 of the storage unit 3. 5-yen coins are stored in the 5-yen storage unit 33 of the storage unit 3. 100-yen coins are stored in the 100-yen storage unit 34 of the storage unit 3. 10-yen coins are stored in the 10-yen storage unit 35 of the storage unit 3. 500-yen coins are stored in the 500-yen storage unit 36 of the storage unit 3. When delivering the money, the storage unit 3 sends out (carries out) the money by denomination to the output-money transfer unit 8. For example, the 1-yen storage unit 31, the 50-yen storage unit 32, the 5-yen storage unit 33, the 100-yen storage unit 34, the 10-yen storage unit 35, and the 500-yen storage unit 36 of the storage unit 3 each include a belt mechanism as a mechanism that sends out money.

The communication unit 4 transmits and receives communication signals. Specifically, the communication unit 4 transmits and receives communication signals between the control unit 1 of the money processing device 100 and the external device 200. The communication unit 4 performs wired communication. Note that the communication unit 4 may perform wireless communication.

The insertion slot 101 is an entrance through which money is input into the money processing device 100. A plurality of money can be input through the insertion slot 101 at the same time.

The return port 102 and the output port 103 are exits through which the money is discharged to the outside of the money processing device 100, respectively.

The return port 102 is used when the money held in the temporary holding unit 6 is returned. That is, when return processing is performed, the money before being stored in the storage unit 3 is returned from the return port 102. In other words, the same money as the money inserted through the insertion slot 101 is returned from the return port 102. The money return is processing of returning the money to a customer when the input money is canceled before settlement.

The output port 103 is used to discharge the money for change and the medium that is not genuine money. The money for change is withdrawn from the storage unit 3. Here, the money for change is money (coins) less than 1000 yen of the amount of money obtained by deducting a price of goods from the amount of input money. Money of 1000 yen or more is separately delivered out of a money processing device for bills. When there is no bill, coins of 1000 yen or more may be discharged.

The input-money transfer unit 5 transfers the money input from the insertion slot 101 to the temporary holding unit 6 or the output port 103. For example, the input-money transfer unit 5 includes a belt mechanism as a mechanism that transfers money.

The money check unit (discrimination unit) 51 is provided in the input-money transfer unit 5. The money check unit 51 determines the denominations of coins input into the insertion slot 101 and whether or not the input coins are genuine (according to the present embodiment, 1-yen coins, 5-yen coins, 10-yen coins, 50-yen coins, 100-yen coins, and 500-yen coins). The money check unit 51 can count the number of input coins by denomination.

The input-money switching gate 52 is provided at a money exit of the input-money transfer unit 5 downstream of the money check unit 51. The input-money switching gate 52 switches the transfer destination route for the medium (coins) inserted through the insertion slot 101 to one of the temporary holding unit 6 and the output port 103.

Specifically, when it is determined in the money check unit 51 that the medium is not genuine money, the input-money switching gate 52 switches the transfer destination route such that the medium is transferred (discharged) to the output port 103. On the other hand, when it is determined in the money check unit 51 that the medium is genuine money, the input-money switching gate 52 switches the transfer destination route such that the money is transferred to the temporary holding unit 6.

The temporary holding unit 6 temporarily holds the money input from the insertion slot 101. Furthermore, the temporary holding unit 6 transfers the temporarily held money to the sorting unit 7 or the return port 102. For example, the temporary holding unit 6 includes a belt mechanism as a mechanism that transfers money.

The storage switching gate 61 is provided at a money exit of the temporary holding unit 6. The storage switching gate 61 switches the transfer destination route for the money temporarily held in the temporary holding unit 6 to one of the sorting unit 7 and the return port 102.

The temporary holding unit 6 can receive the money from the output-money transfer unit 8 that transfers the money withdrawn from the storage unit 3 by switching of the output-money switching gate 81.

The sorting unit 7 transfers the money to the storage unit 3. For example, the sorting unit 7 includes a belt mechanism as a mechanism that transfers money.

In the course of transferring the money, the sorting unit 7 sorts the money by denomination into the 1-yen storage unit 31, the 50-yen storage unit 32, the 5-yen storage unit 33, the 100-yen storage unit 34, the 10-yen storage unit 35, and the 500-yen storage unit 36. For example, the sorting unit 7 separates coins on a transfer path, using a difference in coin size for each denomination, to sort the coins by denomination. That is, the sorting unit 7 delivers the coins in order from the denomination having a smaller diameter to the storage unit 3 to sort the coins.

The output-money transfer unit 8 transfers the money withdrawn from the storage unit 3 to the output port 103 or the temporary holding unit 6. For example, the output-money transfer unit 8 includes a belt mechanism as a mechanism that transfers money.

The output-money switching gate 81 is provided at a money exit of the output-money transfer unit 8. The output-money switching gate 81 switches the transfer destination route for the money withdrawn from the storage unit 3 to one of the temporary holding unit 6 and the output port 103.

The sort counting sensors 91*a* to 91*f* are provided on the side of the sorting unit 7. The sort counting sensors 91*a* to 91*f* are respectively provided in the vicinity of money entrances of the 1-yen storage unit 31, the 50-yen storage unit 32, the 5-yen storage unit 33, the 100-yen storage unit 34, the 10-yen storage unit 35, and the 500-yen storage unit 36. The sort counting sensors 91*a* to 91*f* count the sorted quantity of money to be sorted into the storage unit 3 by denomination.

Regardless of denominations, the sort counting sensors 91*a* to 91*f* are sensors that simply recognize the passage of money and count the quantity of money. The sort counting sensors 91*a* to 91*f* may be any type of sensor such as a transmission-type photosensor, a reflection-type photosensor, a coil-type sensor, etc. as long as the same can count the sorted quantity of money.

The withdrawal counting sensors 92*a* to 92*f* are provided on the side of the output-money transfer unit 8. The withdrawal counting sensors 92*a* to 92*f* are respectively provided in the vicinity of money exits of the 1-yen storage unit 31, the 50-yen storage unit 32, the 5-yen storage unit 33, the 100-yen storage unit 34, the 10-yen storage unit 35, and the 500-yen storage unit 36. The withdrawal counting sensors 92*a* to 92*f* count the withdrawn quantity of money by denomination from the storage unit 3.

Regardless of denominations, the withdrawal counting sensors 92*a* to 92*f* are sensors that simply recognize the passage of money and count the quantity of money. The withdrawal counting sensors 92*a* to 92*f* may be any type of sensor such as a transmission-type photosensor, a reflection-type photosensor, a coil-type sensor, etc. as long as the same can count the withdrawn quantity of money.

The discharge counting sensor 93 is provided between the temporary holding unit 6 and the return port 102. That is, the discharge counting sensor 93 is provided in the middle of a money transfer path that connects the storage switching gate 61 to the return port 102 when the storage switching gate 61 performs switching such that the money is transferred to the return port 102. The discharge counting sensor 93 counts the quantity of money discharged to the return port 102.

Regardless of denominations, the discharge counting sensor 93 is a sensor that simply recognizes the passage of money and counts the quantity of money. The discharge counting sensor 93 may be any type of sensor such as a transmission-type photosensor, a reflection-type photosensor, a coil-type sensor, etc. as long as the same can count the quantity of discharged money.

The residual detection sensor 94 is provided at the return port 102. The residual detection sensor 94 detects the presence or absence of money that remains in the return port 102. The residual detection sensor 94 merely performs a function of detecting the presence or absence of money (medium), and may not be able to determine the denominations and the quantity of money. The residual detection sensor 94 may be any type of sensor such as a transmission-type photosensor, a reflection-type photosensor, a coil-type sensor, etc. as long as the same can detect the presence or absence of money (medium).

The residual detection sensor 95 is provided at the output port 103. The residual detection sensor 95 detects the presence or absence of money that remains in the output port 103. The residual detection sensor 95 merely performs a function of detecting the presence or absence of money (medium), and may not be able to determine the denominations and the quantity of money. The residual detection sensor 95 may be any type of sensor such as a transmission-type photosensor, a reflection-type photosensor, a coil-type sensor, etc. as long as the same can detect the presence or absence of money (medium).

The control unit 201 of the external device 200 includes a CPU and a memory, and controls each unit of the device 200. Specifically, the control unit 201 stores information in the memory storage unit 202 based on a signal from the money processing device 100. In addition, the control unit 201 displays information on the display unit 203 based on a signal from the money processing device 100.

The communication unit 204 transmits and receives communication signals. Specifically, the communication unit 204 transmits and receives communication signals between the control unit 201 and the money processing device 100. The communication unit 204 performs wired communication. Note that the communication unit 204 may perform wireless communication.

According to the present embodiment, the control unit 1 calculates the remaining time or the degree of progress of the examination processing, and performs control of notifying the calculated remaining time or degree of progress of the examination processing. In addition, the control unit 1 performs control of notifying the calculated remaining time or degree of progress of the examination processing on the display unit 203 provided in the external device 200. Furthermore, the control unit 1 stores the calculated remaining time or degree of progress of the examination processing in the memory storage unit 202 provided in the external device 200.

The remaining time of the examination processing is notified by displaying the number of minutes left or the number of seconds left, for example. The degree of progress of the examination processing is notified by displaying what percentage of the examination processing has been completed, for example.

When conducting the examination processing, the control unit 1 may perform control of sequentially measuring the quantities of money in the 1-yen storage unit 31, the 50-yen storage unit 32, the 5-yen storage unit 33, the 100-yen storage unit 34, the 10-yen storage unit 35, and the 500-yen storage unit 36 separately from each other. In addition, the control unit 1 may perform control of measuring the quantity of money in each of the plurality of storage units as one set among the 1-yen storage unit 31, the 50-yen storage unit 32, the 5-yen storage unit 33, the 100-yen storage unit 34, the 10-yen storage unit 35, and the 500-yen storage unit 36. Furthermore, the control unit 1 may perform control of measuring the quantity of money in all of the 1-yen storage unit 31, the 50-yen storage unit 32, the 5-yen storage unit 33, the 100-yen storage unit 34, the 10-yen storage unit 35, and the 500-yen storage unit 36 as one set. The control unit 1 determines a set of storage units to be subjected to the examination processing according to the quantity of money in the storage unit 3 being managed. For example, a set of storage units is determined such that the estimated quantity of money in the set of storage units does not exceed the quantity of money that can be held in the temporary holding unit 6. In this case, the control unit 1 may overestimate the quantity of money in the storage unit 3 being managed. Thus, when the quantity of money larger than the quantity of money in the storage unit 3 being managed is stored in the storage unit 3, it is possible to significantly reduce or prevent the possibility that the money to be examined does not fit inside the temporary holding unit 6.

The control unit 1 determines, based on the quantity of money, a combination of sets of the 1-yen storage unit 31, the 50-yen storage unit 32, the 5-yen storage unit 33, the 100-yen storage unit 34, the 10-yen storage unit 35, and the 500-yen storage unit 36 of the storage unit 3 on which the examination processing is performed. In addition, the control unit 1 determines the order of performing the examination processing on the sets.

The control unit 1 recalculates the remaining time or the degree of progress of the examination processing when additional examination processing occurs. The additional examination processing occurs when the quantity of money in the storage unit 3 managed by the control unit 1 is different from the quantity of money in the storage unit 3 measured through the examination processing, for example. Furthermore, the additional examination processing occurs when the quantity of money withdrawn from the storage unit 3 and measured by the withdrawal counting sensors 92*a* to 92*f* is different from the quantity of money measured by the sort counting sensors 91*a* to 91*f* and stored again in the storage unit 3, for example. The additional examination processing is performed on the denomination of money concerned. In other words, the additional examination processing does not occur on the denomination of money, the quantity of which being managed has been determined to be correct as a result of the examination processing.

When recalculating the remaining time or the degree of progress of the examination processing, the control unit 1 performs control of notifying the recalculated remaining time or degree of progress of the examination processing. Specifically, the control unit 1 updates the remaining time or the degree of progress that has already been notified to the recalculated remaining time or degree of progress of the examination processing and notifies the recalculated one.

The control unit 1 calculates the remaining time of the examination processing based on the time required to withdraw, from the storage unit 3, the money stored in the storage unit 3, the time required to store, in the storage unit 3, the money withdrawn from the storage unit 3, the empty determination time required to determine that the storage unit 3 is empty, and the predicted quantity of money that seems to be in the storage unit 3. That is, at the start of examination, the control unit 1 calculates the remaining time of the examination processing for one set, assuming that the remaining time of the examination processing (one set)= ((withdrawal time required to withdraw one money×maximum quantity of money being managed)+(time required to store one money×total quantity of money being managed for the set)+empty determination time). Then, the control unit 1 similarly calculates and sums the remaining time of the examination processing for all the sets to obtain the remaining time of the examination processing. Here, the empty determination time is a time required to determine that there is no more money in the storage unit 3 when the money is delivered out of the storage unit 3. That is, when the money remains in the storage unit 3, the money is continuously discharged from the storage unit 3. On the other hand, when there is no money in the storage unit 3, the money is no longer discharged after the last money. In other words, when a predetermined time or more has elapsed since money detection by the withdrawal counting sensors 92*a* to 92*f*, the control unit 1 determines that there is no money in the storage unit 3. The empty determination time is set according to the withdrawal speed from the storage unit 3. Furthermore, the maximum quantity is the quantity of money of the denomination of a largest quantity of money in the same set. In other words, when examination is performed on the same set, a plurality of denominations of money is withdrawn concurrently, and thus the time required to withdraw the denomination of a largest quantity of money from the storage unit 3 is the withdrawal time.

Here, during the examination processing, the control unit 1 performs control of withdrawing, from the storage unit 3 at a high speed, the money stored in the storage unit 3 and control of withdrawing, from the storage unit 3 at a low speed, the money stored in the storage unit 3. The money is withdrawn at a high speed such that the time required for the examination processing can be reduced. The money is withdrawn at a low speed such that the quantity of money can be accurately measured. In this case, the control unit 1 calculates the remaining time of the examination processing based on the time required to withdraw, from the storage unit 3 at a high speed, the money stored in the storage unit 3, the predicted quantity of money, which seems to be in the storage unit 3, to be withdrawn at a high speed, the time required to withdraw, from the storage unit 3 at a low speed, the money stored in the storage unit 3, the predicted quantity of money, which seems to be in the storage unit 3, to be withdrawn at a low speed, the time required to store, in the storage unit 3, the money withdrawn from the storage unit 3, and the empty determination time. That is, at the start of the examination, the control unit 1 calculates the remaining time of the examination processing for one set, assuming that the remaining time of the examination processing (one set)=((high-speed withdrawal time required to withdraw one money at a high speed×maximum storage quantity of money being managed to be withdrawn at a high speed)+(low-speed withdrawal time required to withdraw one money at a low speed×maximum storage quantity of money being managed to be withdrawn at a low speed)+(storage time required to store one money×total quantity of money being managed for the set)+empty determination time). Then, the control unit 1 similarly calculates and sums the remaining time of the examination processing for all the sets to obtain the remaining time of the examination processing.

The control unit 1 calculates the degree of progress of the examination processing based on the remaining time of the examination processing calculated at the start of the examination processing and the elapsed time. That is, the control unit 1 calculates the degree of progress from the elapsed time and an arrival point, taking the remaining time of the examination processing calculated at the start of the examination processing as the arrival point.

In consideration of occurrence of the additional examination processing, the control unit 1 notifies the degree of progress smaller than the calculated degree of progress of the examination processing. When determining that the additional examination processing does not occur, the control unit 1 notifies the calculated degree of progress of the examination processing, and when the additional examination processing occurs, the control unit 1 notifies the degree of progress more progressed than the notified degree of progress as the continuation of the notified degree of progress. That is, the control unit 1 notifies the degree of progress with a predetermined degree of progress as an upper limit. When the additional examination processing occurs, the control unit 1 notifies the degree of progress of a continuation from the degree of progress set as the upper limit. On the other hand, when the additional examination processing does not occur, the degree of progress set as the upper limit is switched to the degree of progress indicating that the examination processing is completed, and notice is given.

Next, display of the remaining time of the examination processing of the money processing device 100 is described with reference to FIG. 3.

Figure 3:
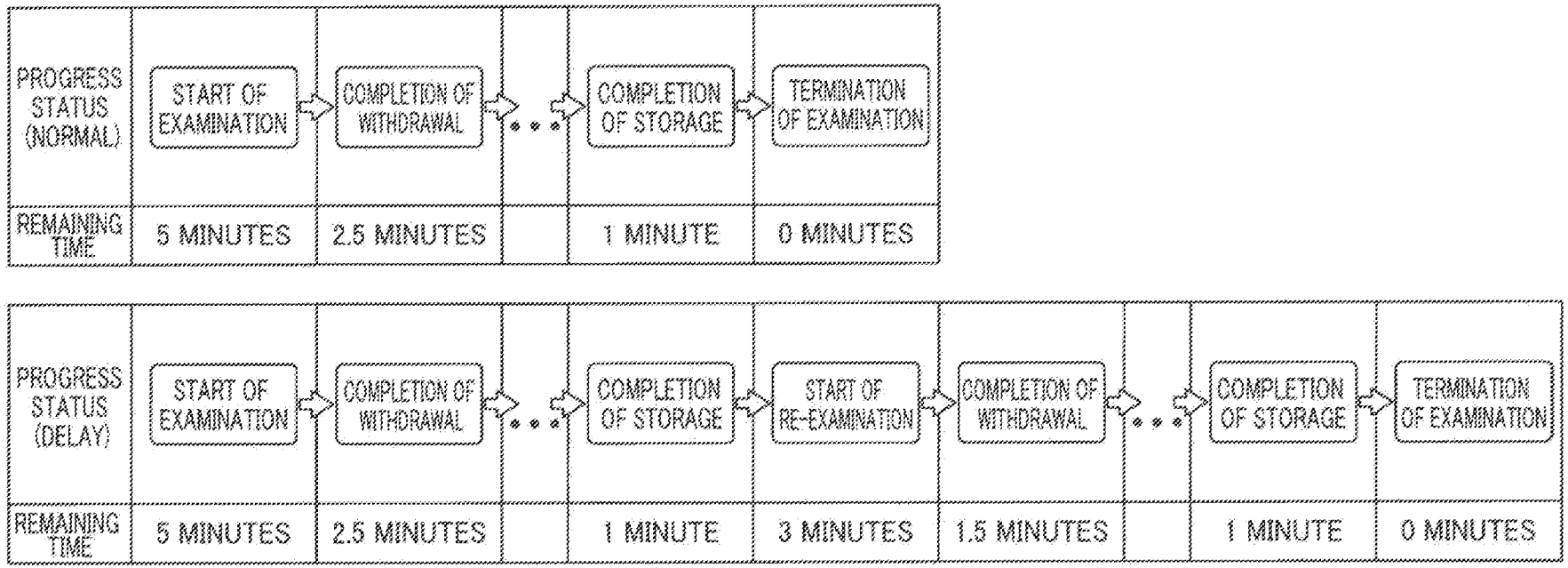
FIG. 3 is a diagram showing an example of a display of the remaining time of examination processing of the money processing device according to the embodiment of the present invention.

In an example shown in FIG. 3, in the case of normal examination processing (when the additional examination processing does not occur), at the start of the examination, the remaining time calculated at the start of the examination is displayed. For example, 5 minutes is displayed. Thereafter, when the processing proceeds, and the withdrawal is completed, the time obtained by subtracting the elapsed time until the completion of the withdrawal from the remaining time at the start of the examination is displayed as the remaining time. For example, 2.5 minutes is displayed. When the processing further proceeds, and the storage is completed, the time obtained by subtracting the elapsed time until the completion of the storage from the remaining time at the start of the examination is displayed as the remaining time. For example, 1 minute is displayed. When the examination is terminated, 0 minutes is displayed.

On the other hand, in the example shown in FIG. 3, when a delay occurs (when the additional examination processing occurs), at the start of the examination, the remaining time calculated at the start of the examination is displayed. For example, 5 minutes is displayed. Thereafter, when the processing proceeds, and the withdrawal is completed, the time obtained by subtracting the elapsed time until the completion of the withdrawal from the remaining time at the start of the examination is displayed as the remaining time. For example, 2.5 minutes is displayed. When the processing further proceeds, and the storage is completed, the time obtained by subtracting the elapsed time until the completion of the storage from the remaining time at the start of the examination is displayed as the remaining time. For example, 1 minute is displayed.

Here, re-examination occurs. Then, the remaining time of the examination processing is recalculated at the start of the re-examination. At the start of the re-examination, the remaining time calculated at the start of the re-examination is displayed. For example, 3 minutes is displayed. Thereafter, when the processing proceeds, and the withdrawal is completed, the time obtained by subtracting the elapsed time until the completion of the withdrawal from the remaining time at the start of the re-examination is displayed as the remaining time. For example, 1.5 minutes is displayed. When the processing further proceeds, and the storage is completed, the time obtained by subtracting the elapsed time until the completion of the storage from the remaining time at the start of the re-examination is displayed as the remaining time. For example, 1 minute is displayed. When the re-examination is terminated, 0 minutes is displayed.

Next, display of the degree of progress of the examination processing of the money processing device 100 is described with reference to FIG. 4.

Figure 4:
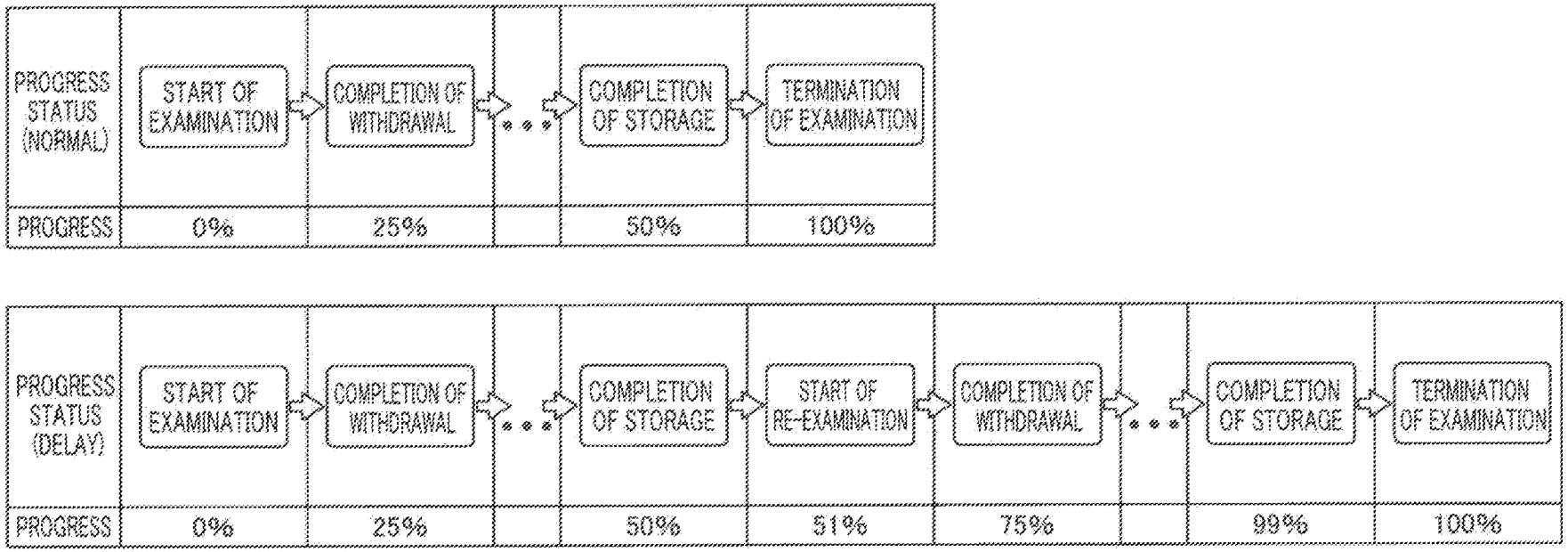
FIG. 4 is a diagram showing an example of a display of the degree of progress of the examination processing of the money processing device according to the embodiment of the present invention.

In an example shown in FIG. 4, in the case of the normal examination processing (when the additional examination processing does not occur), at the start of the examination, the degree of progress is displayed as 0%, for example. Thereafter, when the processing proceeds, and the withdrawal is completed, the degree of progress based on the remaining time at the start of the examination and the elapsed time until the completion of the withdrawal is displayed. For example, 25% is displayed. When the processing further proceeds, and the storage is completed, the degree of progress based on the remaining time at the start of the examination and the elapsed time until the completion of the storage is displayed. For example, 50% is displayed. When the examination is completed, 100% is displayed. In other words, in consideration of the case where the examination processing does not proceed on time (the case where the re-examination occurs), the percentage of an arrival point at the termination of the examination is set to 50%. When there is no delay factor and the examination terminates normally, the notification is immediately updated from 50% to 100%.

On the other hand, in the example shown in FIG. 4, when a delay occurs (when the additional examination processing occurs), at the start of the examination, the degree of progress is displayed as 0%, for example. Thereafter, when the processing proceeds, and the withdrawal is completed, the degree of progress based on the remaining time at the start of the examination and the elapsed time until the completion of the withdrawal is displayed. For example, 25% is displayed. When the processing further proceeds, and the storage is completed, the degree of progress based on the remaining time at the start of the examination and the elapsed time until the completion of the storage is displayed. For example, 50% is displayed.

Here, the re-examination occurs. Then, the remaining time of the examination processing is recalculated at the start of the re-examination. At the start of the re-examination, the degree of progress of a continuation from 50% is displayed. For example, 51% is displayed. Thereafter, when the processing proceeds, and the withdrawal is completed, the degree of progress based on the remaining time at the start of the re-examination and the elapsed time until the completion of the withdrawal is displayed. For example, 75% is displayed. When the processing further proceeds, and the storage is completed, the degree of progress based on the remaining time at the start of re-examination and the elapsed time until the completion of the storage is displayed. For example, 99% is displayed. When the re-examination is terminated, 100% is displayed.

When there is a delay factor, a re-arrival point is determined from the recalculated remaining time, and a percentage is calculated from the elapsed time and the re-arrival point of the additional processing. 0% to 50% is a range calculated from the initially scheduled time, and 51% to 100% is a range calculated from the time of the additional processing.

(Advantageous Effects of Embodiment)

According to the present embodiment, the following advantageous effects are achieved.

According to the present embodiment, as described above, the money processing device 100 includes the control unit 1 that performs control of calculating the remaining time or the degree of progress of the examination processing and notifying the calculated remaining time or degree of progress of the examination processing. Thus, the user can recognize the remaining time or the degree of progress of the examination processing, and thus the user can leave the money processing device 100 or can easily predict the working time. Consequently, it is possible to improve the working efficiency of the user when the examination processing is conducted.

According to the present embodiment, as described above, the control unit 1 performs control of notifying the calculated remaining time or degree of progress of the examination processing on the display unit 203 provided in the external device 200. Thus, the user can easily visually confirm the remaining time or the degree of progress of the examination processing on the display unit 203 of the external device 200.

According to the present embodiment, as described above, the control unit 1 stores the calculated remaining time or degree of progress of the examination processing in the memory storage unit 202 provided in the external device 200. Thus, the remaining time or the degree of progress of the examination processing can be stored as a log in the memory storage unit 202, and thus the log is analyzed such that the accuracy of calculating the remaining time or the degree of progress can be improved.

According to the present embodiment, as described above, the control unit 1 recalculates the remaining time or the degree of progress of the examination processing when the additional examination processing occurs. Thus, even when the additional examination processing occurs and the examination processing does not proceed based on the time calculated at the start of the examination, it is possible to recalculate and notify the remaining time or the degree of progress of the examination processing, and thus the user can recognize the accurate remaining time or the degree of progress even when the additional examination processing occurs.

According to the present embodiment, as described above, the control unit 1 performs control of notifying the recalculated remaining time or degree of progress of the examination processing when recalculating the remaining time or the degree of progress of the examination processing. Thus, even when the additional examination processing occurs and the examination processing does not proceed based on the time calculated at the start of the examination, it is possible to recalculate and notify the remaining time or the degree of progress of the examination processing, and thus the user can correct the schedule. Accordingly, even when the time of the examination processing is extended, it is possible to significantly reduce or prevent a decrease in the working efficiency of the user.

According to the present embodiment, as described above, the control unit 1 calculates the remaining time of the examination processing based on the time required to withdraw the money from the storage unit, the time required to store the money in the storage unit, the empty determination time required to determine that the storage unit is empty, and the predicted quantity of money. Thus, the remaining time of the examination processing can be easily calculated according to the predicted quantity of money.

According to the present embodiment, as described above, the control unit 1 calculates the remaining time of the examination processing based on the time required to withdraw the money from the storage unit 3 at a high speed, the predicted quantity of money to be withdrawn at a high speed, the time required to withdraw the money from the storage unit 3 at a low speed, the predicted quantity of money to be withdrawn at a low speed, the time required to store the money in the storage unit, and the empty determination time. Thus, the time can be calculated by distinguishing the case where the money is withdrawn from the storage unit 3 at a high speed from the case where the money is withdrawn from the storage unit 3 at a low speed, and thus the remaining time of the examination processing can be calculated more accurately.

According to the present embodiment, as described above, the control unit 1 calculates the degree of progress of the examination processing based on the remaining time of the examination processing calculated at the start of the examination processing and the elapsed time. Thus, the degree of progress of the examination processing can be calculated on the basis of time, and thus the user who has confirmed the degree of progress of the examination processing can easily recognize the progress of the examination processing.

According to the present embodiment, as described above, the control unit 1 notifies the degree of progress smaller than the calculated degree of progress of the examination processing in consideration of the occurrence of the additional examination processing, notifies the calculated degree of progress of the examination processing when it is determined that the additional examination processing does not occur, and notifies the degree of progress more progressed than the notified degree of progress as the continuation of the notified degree of progress when the additional examination processing occurs. Thus, even when the additional examination processing occurs, the degree of progress more progressed than the originally notified degree of progress is notified, and the notified degree of progress is not reduced, and thus it is possible to significantly reduce or prevent occurrence of an excessive waiting time for the user who expects the examination processing to terminate.

(Modified Examples)

The embodiment disclosed this time must be considered as illustrative in all points and not restrictive. The range of the present invention is not shown by the above description of the embodiment but by the scope of claims for patent, and all modifications (modified examples) within the meaning and range equivalent to the scope of claims for patent are further included.

For example, while the present invention is applied to the money processing device capable of storing coins in the aforementioned embodiment, the present invention is not restricted to this. The present invention may alternatively be applied to a money processing device capable of storing bills (banknotes). That is, when the number of bills is examined, the remaining time or the degree of progress of the examination processing may be calculated, and the calculated remaining time or degree of progress of the examination processing may be notified.

While the money processing device stores money of Japanese yen money and conducts the examination processing in the aforementioned embodiment, the present invention is not restricted to this. According to the present invention, the currency processing device may alternatively store money other than Japanese yen and conduct the examination processing.

While the remaining time of the examination processing at the start of the examination processing or at the start of the re-examination processing is calculated in the aforementioned embodiment, the present invention is not restricted to this. According to the present invention, during the examination processing, the remaining time may alternatively be sequentially calculated based on the remaining processing. Furthermore, the degree of progress may alternatively be sequentially calculated based on the remaining processing.

While the display unit that displays the remaining time or the degree of progress of the examination processing is provided in the external device in the aforementioned embodiment, the present invention is not restricted to this. According to the present invention, the display unit that displays the remaining time or the degree of progress of the examination processing may alternatively be provided in the money processing device.

While the memory storage unit that stores the remaining time or the degree of progress of the examination processing is provided in the external device in the aforementioned embodiment, the present invention is not restricted to this. According to the present invention, the memory storage unit that stores the remaining time or the degree of progress of the examination processing may alternatively be provided in the money processing device. For example, the remaining time or the degree of progress of the examination processing may be stored in a memory storage unit provided as a memory in the money processing device, or the remaining time or the degree of progress of the examination processing may be stored in a memory storage unit externally mounted on the money processing device.

While the money processing device includes the temporary holding unit in the aforementioned embodiment, the present invention is not restricted to this. According to the present invention, the money processing device may not include the temporary holding unit.

While the money is circulated inside the money processing device to conduct the examination processing in the aforementioned embodiment, the present invention is not restricted to this. According to the present invention, the examination processing may alternatively be conducted while the money is discharged to the outside of the money processing device.

While the remaining time or the degree of progress of the examination processing is notified by display on the display unit in the aforementioned embodiment, the present invention is not restricted to this. According to the present invention, the remaining time or the degree of progress of the examination processing may alternatively be audibly notified, for example.

What is claimed is:

1. A money processing device comprising:

a storage unit that stores money;

a quantity measurement unit that measures a quantity of the money stored in the storage unit during examination processing of the money; and a control unit that performs control of calculating a remaining time or a degree of progress of the examination processing that includes delivering the money from the storage unit, measuring the quantity of the delivered money and returning the money whose quantity is measured to the storage unit, and notifying calculated remaining time or degree of progress of the examination processing.

2. The money processing device according to claim 1, wherein the control unit performs control of notifying the calculated remaining time or degree of progress of the examination processing on a display unit provided in the money processing device or an external device.

3. The money processing device according to claim 1, wherein the control unit stores the calculated remaining time or degree of progress of the examination processing in a memory storage unit provided in the money processing device or an external device.

4. The money processing device according to claim 1, wherein the control unit recalculates the remaining time or the degree of progress of the examination processing when additional examination processing occurs.

5. The money processing device according to claim 4, wherein the control unit performs control of notifying recalculated remaining time or degree of progress of the examination processing when the remaining time or the degree of progress of the examination processing is recalculated.

6. The money processing device according to claim 1, wherein the control unit calculates the remaining time of the examination processing based on a time required to withdraw, from the storage unit, the money stored in the storage unit, a time required to store, in the storage unit, the money withdrawn from the storage unit, an empty determination time required to determine that the storage unit is empty, and a predicted quantity of the money that seems to be in the storage unit.

7. The money processing device according to claim 6, wherein the control unit calculates the remaining time of the examination processing based on a time required to withdraw, from the storage unit at a first speed, the money stored in the storage unit, a predicted quantity of the money, which seems to be in the storage unit, to be withdrawn at the first speed, a time required to withdraw, from the storage unit at a second speed lower than the first speed, the money stored in the storage unit, a predicted quantity of the money, which seems to be in the storage unit, to be withdrawn at the second speed, the time required to store, in the storage unit, the money withdrawn from the storage unit, and the empty determination time.

8. The money processing device according to claim 1, wherein the control unit calculates the degree of progress of the examination processing based on the remaining time of the examination processing calculated at a start of the examination processing and an elapsed time.

9. The money processing device according to claim 1, wherein the control unit notifies the degree of progress smaller than the calculated degree of progress of the examination processing in consideration of occurrence of additional examination processing, notifies the calculated degree of progress of the examination processing when it is determined that the additional examination processing does not occur, and notifies the degree of progress more progressed than the notified degree of progress as a continuation of the notified degree of progress when the additional examination processing occurs.

* * * * *